US011814792B2

(12) United States Patent
Kennedy

(10) Patent No.: US 11,814,792 B2
(45) Date of Patent: Nov. 14, 2023

(54) PAPER WEB AIR FOIL OF A PAPERMAKING MACHINE

(71) Applicant: First Quality Tissue, LLC, Great Neck, NY (US)

(72) Inventor: Theodore D. Kennedy, San Mateo, FL (US)

(73) Assignee: First Quality Tissue, LLC, Great Neck, NY (US)

( * ) Notice: Subject to any disclaimer, the term of this patent is extended or adjusted under 35 U.S.C. 154(b) by 0 days.

(21) Appl. No.: 17/477,772

(22) Filed: Sep. 17, 2021

(65) Prior Publication Data

US 2022/0090320 A1 Mar. 24, 2022

Related U.S. Application Data

(60) Provisional application No. 63/081,534, filed on Sep. 22, 2020.

(51) Int. Cl.
*D21F 5/18* (2006.01)

(52) U.S. Cl.
CPC ..... *D21F 5/188* (2013.01)

(58) Field of Classification Search
CPC . D21F 5/188; D29G 9/00; D21C 1/10; D21G 3/005
See application file for complete search history.

(56) References Cited

U.S. PATENT DOCUMENTS 5,891,309 A * 4/1999 Page ..... D21G 9/0063 162/207
2008/0276488 A1* 11/2008 Seidl ..... B65H 23/24 34/623
2012/0145347 A1* 6/2012 Ponka ..... D21G 1/0086 162/283

* cited by examiner

*Primary Examiner* — Eric Hug
*Assistant Examiner* — Matthew M Eslami
(74) *Attorney, Agent, or Firm* — Amster, Rothstein & Ebenstein LLP

(57) ABSTRACT

A papermaking machine air foil including a housing having a top surface, a bottom surface, side surfaces, a leading edge and a trailing edge, at least one air inlet on the top surface that directs injected air into the housing, and an air slot formed in the bottom surface that directs ejected air from the housing towards a trailing edge of the air foil, the air slot having a V-shape. The papermaking machine air foil is configured to be disposed on top of a paper web at a position adjacent to a Yankee dryer so that the ejected air directed by the air slot of the air foil stabilizes the paper web as the paper web is removed from the Yankee dryer.

16 Claims, 6 Drawing Sheets

PAPER WEB AIR FOIL OF A PAPERMAKING MACHINE

RELATED APPLICATIONS

This application claims priority to and the benefit of U.S. Provisional Application No. 63/081,534, filed Sep. 22, 2020 and entitled Paper Web Air Foul of a Papermaking Machine, the contents of which are incorporated herein by reference in their entirety.

FIELD OF THE INVENTION

The present invention relates to devices for stabilizing a paper web in a papermaking machine in general, and in particular to devices for stabilizing a paper web dried on a Yankee dryer, Through Air Dryer (hereinafter referred to as TAD) or other tissue and towel making apparatus and processes, including winder equipment and processes and web converting equipment and processes.

BACKGROUND

Lightweight grades of paper which have a soft absorbing texture are formed by drying the paper web on a single large drying cylinder referred to as a Yankee dryer. The lightweight paper web, after being formed in the forming section of a papermaking machine and pressed in a press section, is dried on the surface of the Yankee dryer (while supported on fabrics). The paper web is pressed on the Yankee dryer by a press roll. The Yankee dryer is heated by steam which is supplied to the interior of the Yankee dryer. An aircap placed over the top of the Yankee dryer blows high velocity heated air down onto the dryer surface to increase the drying rate of the Yankee dryer.

The paper dried on the Yankee dryer is given its characteristic absorbency by a creping action which takes place at the doctor blade, which scrapes off paper from the surface of the Yankee dryer. The scraping action of the doctor blade compresses the paper. Lightweight grades of tissue which are produced on the Yankee dryer are fabricated at relatively high-speed.

The paper is rolled up on a reel to create a parent roll. There is a significant distance the paper travels from the Yankee to the reel and the paper is not supported on a fabric during this run. The low strength of the tissue as it is removed from the Yankee dryer by the doctor blade and an unstable web run can create problems and lead to frequent breaks of the paper web. Increasing web tension to avoid paper breaks by increasing tension produced by the reel can result in the web being stretched, which reduces its absorbency. The increased tension may also pull the edges of the paper inward. Defects on the edges of the paper may be susceptible to tearing which leads to machine down time.

In existing tissue making machines the necessity of frequent cleaning and removing broke from the vicinity of the doctor blade has prevented the placement of any paper support sufficiently close to the doctor blade to prevent occasional paper breaks. Skinning doctor blades positioned ahead of the creping doctor have been used to deflect air from the aircap and from the air naturally moving with the paper web away from the web before it is scraped from the Yankee dryer roll, yet the effectiveness of such a skinning doctor blade is limited.

U.S. Pat. No. 5,891,309 teaches a web support foil positioned adjacent to a Yankee dryer just after the creping doctor. The foil overlies the tissue web which is being scraped off the Yankee dryer and supports the web as it leaves the dryer. Mounted to the top of the foil is an adjustable air deflector in the form of an adjustable blade which is positioned as close as practicable to the Yankee dryer. The blade blocks air from the aircap and from the boundary layer moving along with the web and deflects the air over the top of the foil. There is a need for an improved air foil which can decrease paper breaks.

SUMMARY OF THE INVENTION

In an exemplary embodiment, the present invention provides a papermaking machine air foil including a housing having an upper surface, a lower surface and side surfaces; at least one air inlet on the upper surface; and an active air slot on the lower surface.

A papermaking machine air foil according to an exemplary embodiment of the present invention comprises: a housing having a top surface, a bottom surface, side surfaces, a leading edge and a trailing edge; at least one air inlet on the top surface that directs injected air into the housing; and an air slot formed in the bottom surface that directs ejected air from the housing towards a trailing edge of the air foil, the air slot having a V-shape, wherein the papermaking machine air foil is configured to be disposed on top of a paper web at a position adjacent to a Yankee dryer so that the ejected air directed by the air slot of the air foil stabilizes the paper web as the paper web is removed from the Yankee dryer.

According to an exemplary embodiment the at least one air inlet comprises at least two air inlets.

According to an exemplary embodiment one of the at least two air inlets is configured to accommodate compressed air at a pressure of 20 psi to 70 psi.

According to an exemplary embodiment the one of the at least two air inlets has a diameter of 0.5 to 1.5 inches.

According to an exemplary embodiment the one of the at least two air inlets has a diameter of 0.75 inch.

According to an exemplary embodiment at least one other of the at least two air inlets is configured to accommodate blower air at a pressure lower than the compressed air accommodated by the one of the at least two air inlets.

According to an exemplary embodiment the at least one other of the at least two air inlets has a diameter of 3 to 8 inches.

According to an exemplary embodiment the at least one other of the at least two air inlets has a diameter of 3 inches.

According to an exemplary embodiment the bottom surface of the housing comprises an upper plate and a lower plate, and the air slot is formed between the upper plate and the lower plate.

According to an exemplary embodiment the lower plate has a trailing edge and the upper plate has a leading edge, and the air slot is formed between the trailing edge of the lower plate and leading edge of the upper plate.

According to an exemplary embodiment the air foil comprises gussets extending between the upper plate and the lower plate.

According to an exemplary embodiment the air slot has a height of 0.010 inches to 0.020 inches.

According to an exemplary embodiment the air foil has a width as measured in a cross direction of 24 inches to 220 inches.

According to an exemplary embodiment the air foil has a length as measured in the machine direction of 30 inches to 72 inches.

According to an exemplary embodiment the air foil has a height of 4 inches to 6 inches.

According to an exemplary embodiment the air slot comprises a first arm and a second arm that together form the V-shape, and a length of each of the first and second arms is 15 inches to 20 inches.

According to an exemplary embodiment a total length of the air slot is 30 inches to 240 inches.

According to an exemplary embodiment the angle between the first arm and the second arm of the slot is 60 degrees to 120 degrees.

DETAILED DESCRIPTION OF PREFERRED EMBODIMENTS

Figure 1A:
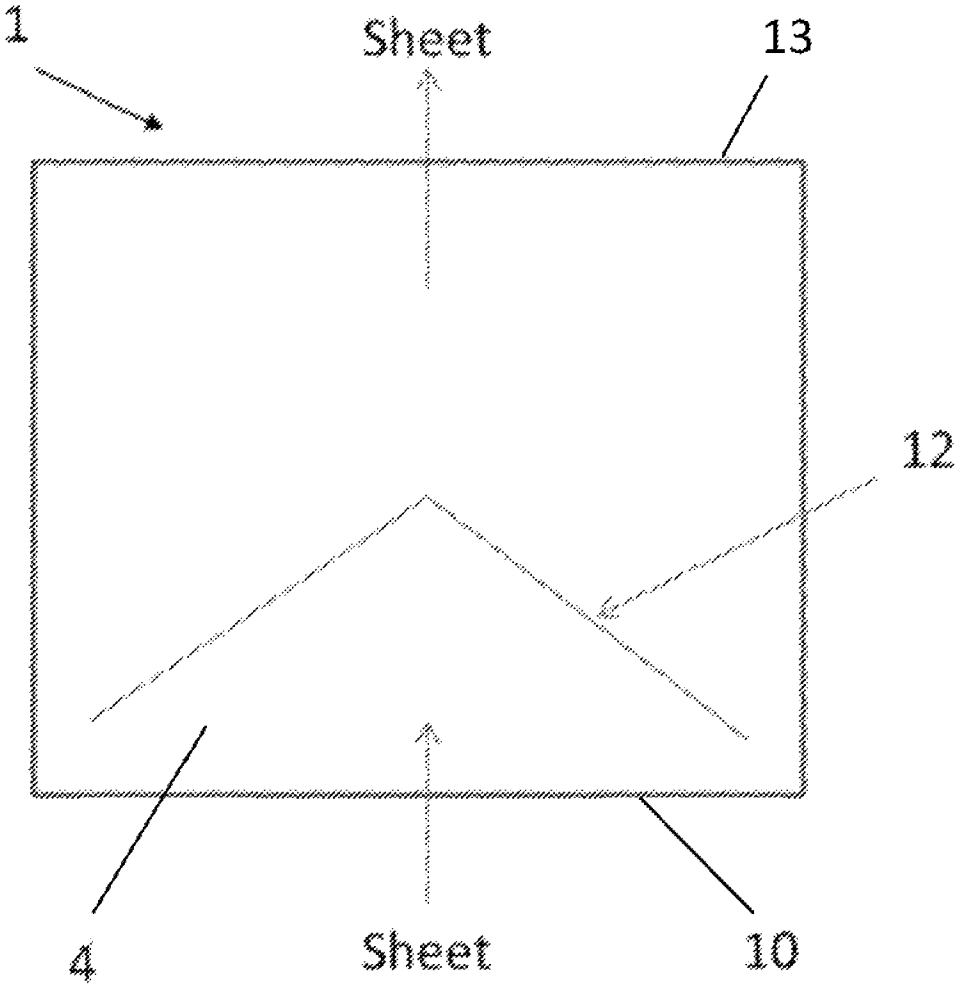
FIG. 1A is a bottom view of an air foil according to an exemplary embodiment of the present invention.
Figure 1B:
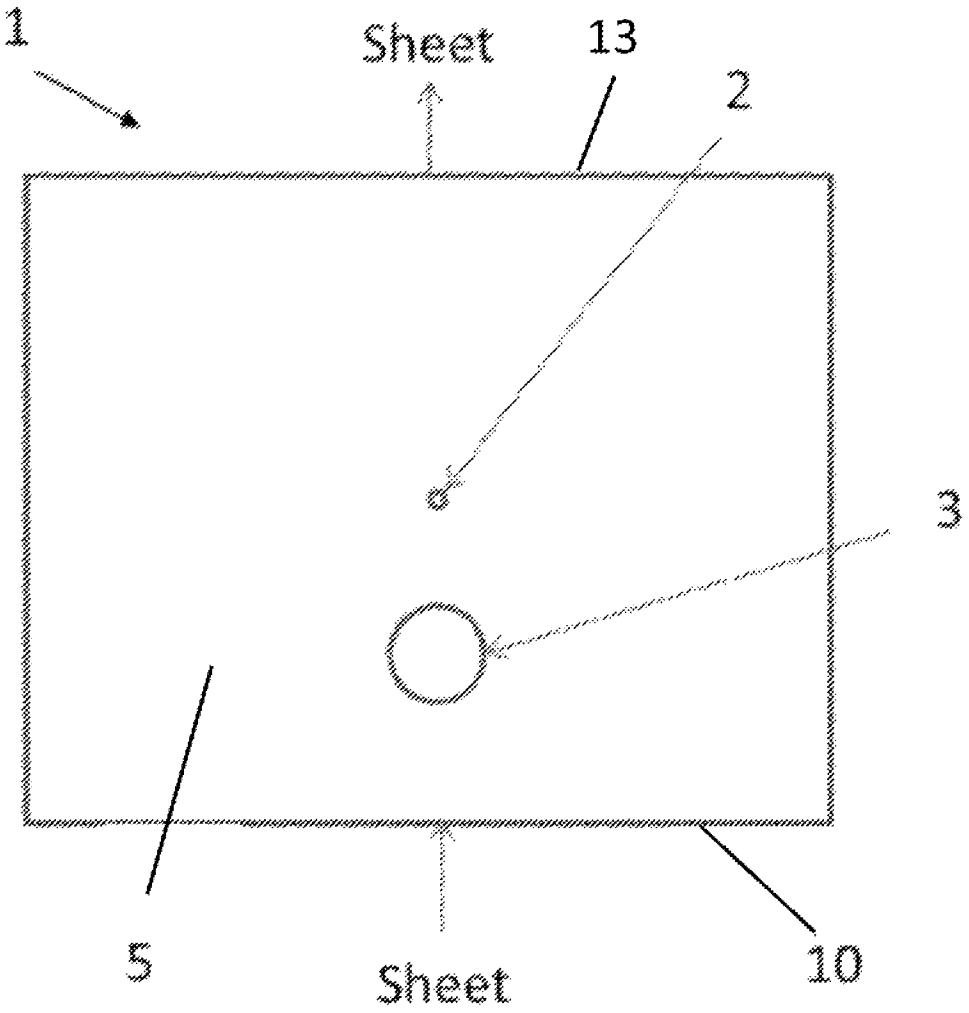
FIG. 1B is a top view of an air foil according to an exemplary embodiment of the present invention.
Figure 2:
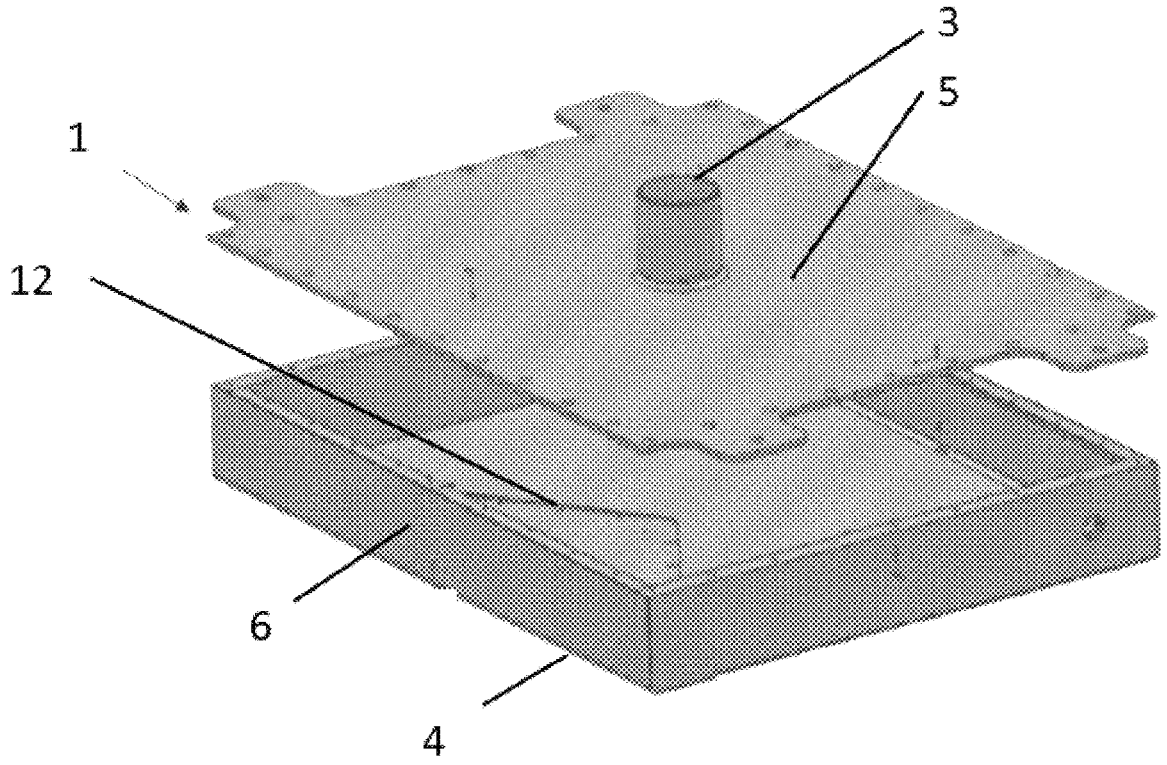
FIG. 2 is an exploded perspective view of an air foil according to an exemplary embodiment of the present invention.
Figure 3:
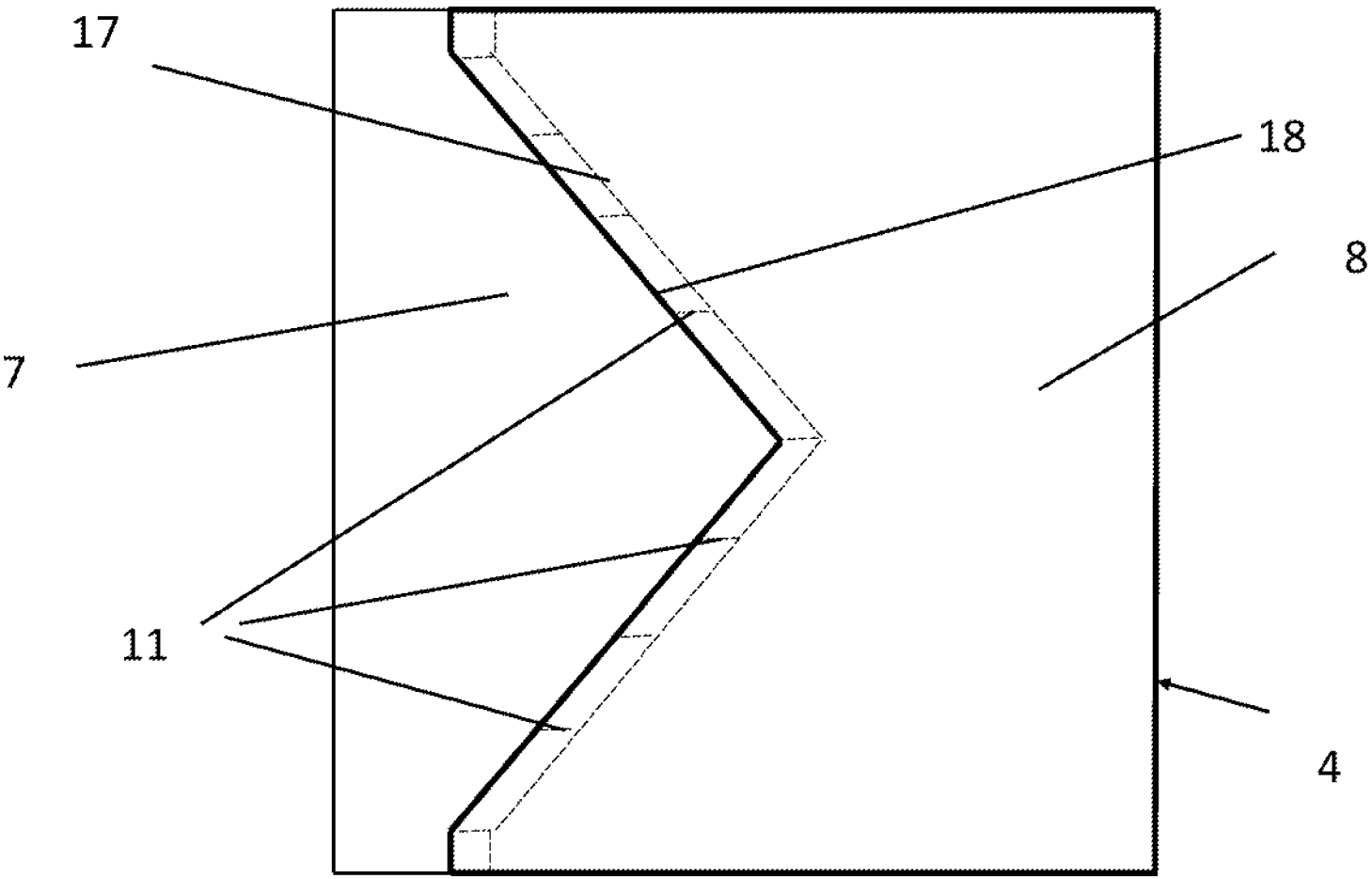
FIG. 3 is a top view of plates that form the bottom surface of an air foil according to an exemplary embodiment of the present invention.
Figure 4:
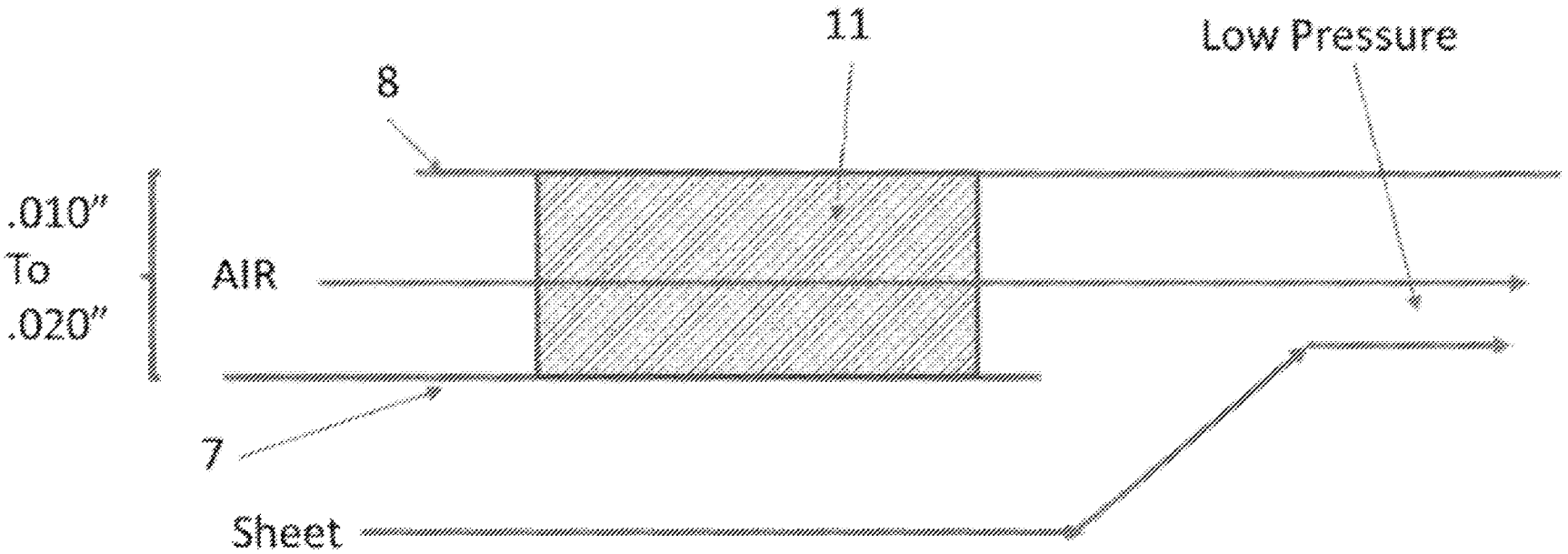
FIG. 4 is a cross section view of the bottom surface of an air according to an exemplary embodiment of the present invention.

FIGS. 1A, 1B, 2, 3, 4 and 5 show an air foil, generally designated by reference number according to an exemplary embodiment of the present invention. Air foil 1 includes bottom surface 4, top surface 5 and side surfaces 6. The air foil 1 is made from soft metals such as stainless steel and the like.

The top surface 5, bottom surface 4 and side surfaces 6 are connected to form a housing. In use, the housing is pressurized. The bottom surface 4 includes a generally V shaped slot 12. The top surface 5 includes air inlets 2, 3. Air inlet 2 has a diameter of about ½ to ½ or ¾ inch and may accommodate compressed air at a pressure of from about 20 to about 70 pounds per square inch (psi). Air inlet 3 has a diameter of about 3 to 8 inches and may accommodate blower air at lower pressures as compared to the pressure of the compressed air. It should be appreciated that the present invention is not limited by these diameters and pressures, and other exemplary embodiments may involve the use of one or more air inlets that accommodate air pressures within ranges other than those provided herein. In exemplary embodiments, air may be supplied to air inlets of the air foil 1 through air supply ducts.

The size of the air foil 1 may vary depending on the size of the paper web made on the machine. In this regard, the air foil 1 may range from about 24 inches to about 220 inches wide as measured in the cross direction. The length of the air foil 1 may range from about 30 inches to about 72 inches as measured in the machine direction. The height of the air foil 1 may range from about 4 inches to about 6 inches.

The generally V shaped slot 12 typically has two arms that are angled with respect to one another to form the V shape. The size of the generally V shaped slot 12 will vary depending on the size (and length to width ratio) of the air foil, but for a 24 inch long air foil the length of each arm will be about 15 inches and the total length of the slot will be about 30 inches. For a larger air foil, the length of each arm may be about 20 inches and the total length of the slot may be about 240 inches. The total length of the slot and the angle of the slot depends on the width of the foil. In exemplary embodiments, the angle between the arms of the slot 12 may be in the range of 60 degrees to 120 degrees. As discussed in further detail below, the slot 12 is formed by two overlapping plates that define the bottom surface 4 of the air foil 1 so that the slot 12 angles pressurized air towards a trailing edge 13 of the air foil 1 (i.e., in the down machine direction). The slot gap or height of the slot 12 defined by the two overlapping plates may range from about 0.010 inches to about 0.020 inches.

The bottom surface 4 of the air foil 1 may be made from two plates, an upper plate 8 and a lower plate 7. As best show in FIGS. 3 and 4, lower plate 7 has a trailing edge 17 that is generally V-shaped, and upper plate 8 has a leading edge 18 that is generally V-shaped with the same profile as the V-shaped trailing edge of the lower plate 7. In this regard, the trailing edges 17, 18 of the lower plate 7 and bottom plate 8, respectively, form V-shapes with an apex of each V-shape pointing in the down machine direction. The slot 12 is formed by placing the bottom surface of the V-shaped leading edge 18 of the upper plate 8 over the top surface of the V-shaped trailing edge 17 of the lower plate 7 and attaching the two plates with gussets 11, thereby forming an active air slot. The attachment may be by welding, adhesive or the like. The gussets 11 are installed so as to extend perpendicular to the slot between the lower plate 7 and the upper plate 8. The gussets 11 maintain slot clearance and direct air perpendicular to the opening of the slot 12 (i.e., in the down machine direction). The gussets 11 may be made from plastics or metals such as stainless steel and the like. The gussets 11 may be arranged every 1 inch to 3 inches, for example every 2 inches, across the slot 12.

The air foil of the present invention supports paper and reduces the likelihood of paper breaks, thereby reducing machine down time. The air foil pushes the paper out to the edges of the foil in the cross direction, providing consistent paper width, while also pushing the paper forward in the machine direction.

In an exemplary embodiment, the slot has two arms that meet at a plateau so as to form a U-shaped slot with a smooth or angular profile. In an exemplary embodiment, one slot is coextensive with the width of the air foil and generally V shaped arms intersect the slot. In an exemplary embodiment, the air foil has three or more slots.

Figure 5:
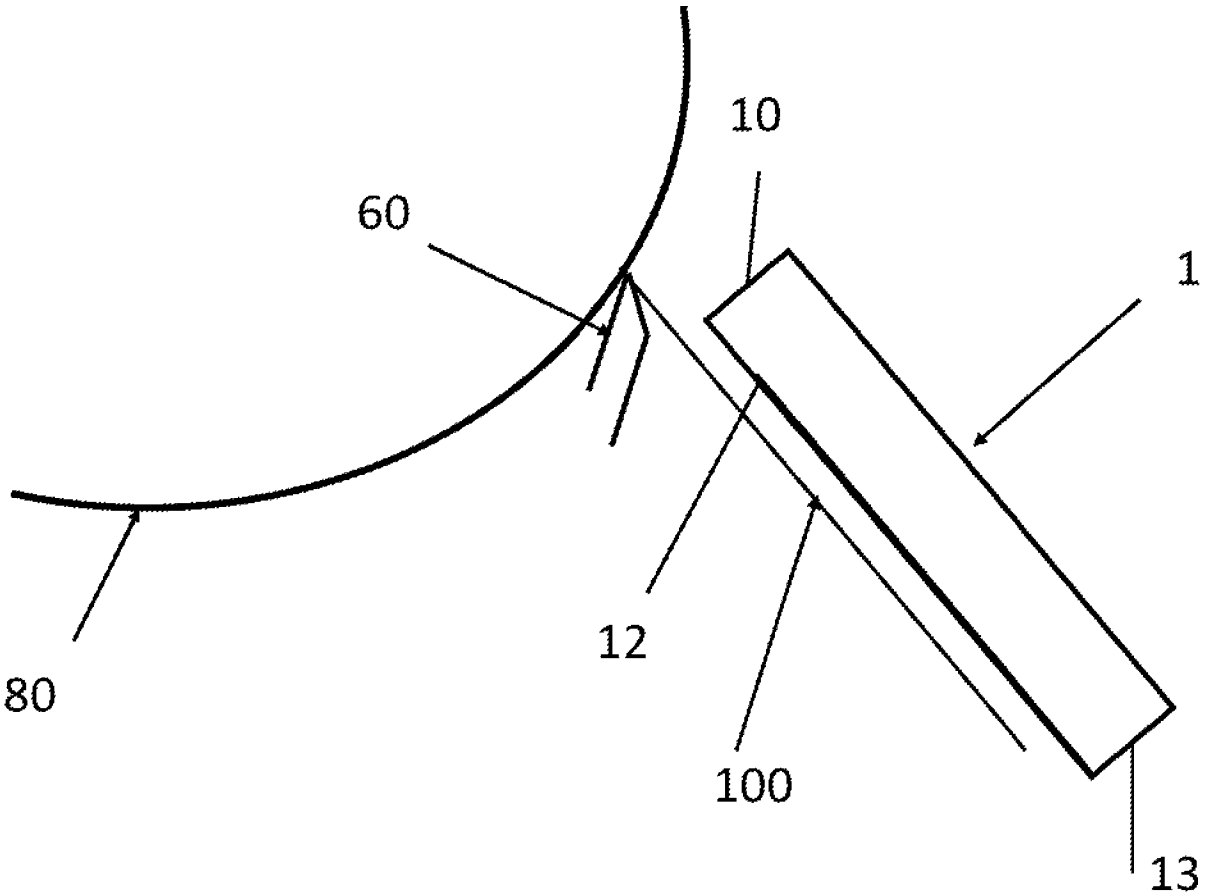
FIG. 5 is a block diagram showing an air foil according to an exemplary embodiment of the present invention in use within a papermaking machine.

As shown in FIG. 5, one or more air foils 1 are suspended above the path of the paper web 100, typically attached to framework around the papermaking machine. The air foil 1 is positioned parallel or substantially parallel to the paper web 100 as it travels away from the Yankee dryer 80 after being scraped from the Yankee dryer 80 by the doctor blade 60. The number of air foils 1 between the Yankee dryer 80 and the reel may vary and, in an exemplary embodiment of the present invention, one to five air foils may be disposed between the Yankee dryer 80 and the red. In a specific exemplary embodiment, four air foils are disposed between the Yankee dryer 80 and the reel. The foil has a leading-edge 10 which is directly opposite and spaced from the Yankee dryer and a trailing edge 13 opposite the leading edge 10. The paper web 100 moves away from the Yankee dryer 80 along the bottom of the foil 1 and towards the reel. Air flows through the inlet 2 or 3 into the foil 1 and out through the slot 12. In embodiments, only one inlet may be used at a time.

The volume of air will vary depending on the inlet used. The combination of the paper movement and air flow creates a Bernoulli effect (similar to vacuum), holding the paper web up against the bottom surface 4 of the air foil 1 as it travels to the reel.

In exemplary embodiments, the air foil of the present invention stabilizes the paper web which in turn reduces web breakage in a tissue forming papermaking machine.

In exemplary embodiments, the slot may be made up of an array of holes arranged in a V-shape rather than a continuous V-shaped opening.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

I claim:

1. A papermaking machine air foil comprising:

a housing having a top surface, a bottom surface opposite the top surface, side surfaces, a leading edge and a trailing edge opposite the leading edge, wherein the top, bottom and side surfaces are connected to one another so as to form an enclosure;

at least one air inlet on the top surface that directs injected air into the enclosure; and an air slot formed in the bottom surface that directs ejected air from the enclosure towards the trailing edge of the air foil, the air slot having a V-shape, wherein the papermaking machine air foil is configured to be disposed on top of a paper web at a position adjacent to a Yankee dryer so that the ejected air directed by the air slot of the air foil stabilizes the paper web as the paper web is removed from the Yankee dryer, wherein the bottom surface of the housing comprises an upper plate and a lower plate, and the air slot is formed between the upper plate and the lower plate, wherein the lower plate has a trailing edge and the upper plate has a leading edge, and the air slot is formed between the trailing edge of the lower plate and leading edge of the upper plate, and wherein the air slot comprises a first arm and a second arm that together form the V-shape.

2. The papermaking machine air foil of claim 1, wherein the at least one air inlet comprises at least two air inlets.

3. The papermaking machine air foil of claim 2, wherein one of the at least two air inlets is configured to accommodate compressed air at a pressure of 20 psi to 70 psi.

4. The papermaking machine air foil of claim 3, wherein the one of the at least two air inlets has a diameter of 0.5 to 1.5 inches.

5. The papermaking machine air foil of claim 3, wherein the one of the at least two air inlets has a diameter of 0.75 inch.

6. The papermaking machine air foil of claim 3, wherein at least one other of the at least two air inlets is configured to accommodate blower air at a pressure lower than the compressed air accommodated by the one of the at least two air inlets.

7. The papermaking machine air foil of claim 6, wherein the at least one other of the at least two air inlets has a diameter of 3 to 8 inches.

8. The papermaking machine air foil of claim 6, wherein the at least one other of the at least two air inlets has a diameter of 3 inches.

9. The papermaking machine air foil of claim 1, wherein the air foil comprises gussets extending between the upper plate and the lower plate.

10. The papermaking machine air foil of claim 1, wherein the air slot has a height of 0.010 inches to 0.020 inches.

11. The papermaking machine air foil of claim 1, wherein the air foil has a width as measured in a cross direction of 24 inches to 220 inches.

12. The papermaking machine air foil of claim 1, wherein the air foil has a length as measured in the machine direction of 30 inches to 72 inches.

13. The papermaking machine air foil of claim 1, wherein the air foil has a height of 4 inches to 6 inches.

14. The papermaking machine air foil of claim 1, wherein a length of each of the first and second arms is 15 inches to 20 inches.

15. The papermaking machine air foil of claim 14, wherein a total length of the air slot is 30 inches to 240 inches.

16. The papermaking machine air foil of claim 14, wherein the angle between the first arm and the second arm of the slot is 60 degrees to 120 degrees.

* * * * *